US007125229B2

(12) United States Patent
Distaso et al.

(10) Patent No.: US 7,125,229 B2
(45) Date of Patent: Oct. 24, 2006

(54) RECIPROCATING AIR DISTRIBUTION SYSTEM

(75) Inventors: Chris Distaso, Fontana, CA (US); Greg S. Duncan, Huntington Beach, CA (US); Robert F. Jack, Riverside, CA (US)

(73) Assignee: Wilden Pump and Engineering LLC, Grand Terrace, CA (US)

( * ) Notice: Subject to any disclaimer, the term of this patent is extended or adjusted under 35 U.S.C. 154(b) by 5 days.

(21) Appl. No.: 10/842,847

(22) Filed: May 10, 2004

(65) Prior Publication Data

US 2005/0249612 A1 Nov. 10, 2005

(51) Int. Cl.
*F04B 43/06* (2006.01)

(52) U.S. Cl. ..... 417/395; 137/625.66

(58) Field of Classification Search ..... 417/395; 137/625.66

See application file for complete search history.

(56) References Cited

U.S. PATENT DOCUMENTS

| | | | | |
|---|---|---|---|---|
| 4,247,264 | A | 1/1981 | Wilden | 417/393 |
| 4,267,862 | A * | 5/1981 | Neff et al. | 137/625.64 |
| 4,524,803 | A * | 6/1985 | Stoll et al. | 137/625.64 |
| 4,549,467 | A | 10/1985 | Wilden | 91/307 |
| 4,587,991 | A * | 5/1986 | Chorkey | 137/454.6 |
| 5,169,296 | A | 12/1992 | Wilden | 417/395 |
| 5,213,485 | A | 5/1993 | Wilden | 417/393 |
| 5,957,670 | A * | 9/1999 | Duncan et al. | 417/395 |
| RE38,239 | E | 8/2003 | Duncan | 417/395 |

* cited by examiner

*Primary Examiner*—Charles G. Freay
(74) *Attorney, Agent, or Firm*—Connolly Bove Lodge & Hutz LLP

(57) ABSTRACT

A reciprocating air distribution system includes a valve housing, having a cylinder therein. A valve element is slidably mounted within the cylinder. Also provided is an inlet to the cylinder, an exhaust from the cylinder and air distribution passages which are controlled by the valve element to be connected either with the intake or the exhaust. A nonmetallic gasket of thermally insulative material and thickness is between the inlet and air distribution passages on one side and the valve element and exhaust on the other. The buna elastomer has carbon black filer to make the gasket statically dissipative. The nonmetallic gasket provides channels which are part of valve control passages which are associated with a pilot valve. The valve control passages are from the inlet to both ends of the cylinder with at least one passage controlled by the pilot valve. These channels are closed by one of the components between which the gasket is located. The reciprocating air distribution system includes a restricted inlet such that the air inlet ports are of a combined area of approximately 0.057 square inches and of a ratio of exhaust port area to inlet port area of approximately 8.0 for models achieving up to 180 gallons per minutes, and the air inlet ports are of a combined area of approximately 0.083 square inches and of a ratio of exhaust port area to inlet port area of approximately 5.4 for models achieving between 180 and 275 gallons per minutes. A muffler is in communication with the exhaust. The muffler includes a cavity open to the housing of the valve and separated by an exhaust gasket. The exhaust gasket includes a locking flange extending into the cavity of the muffler to resist the pressure within the cavity.

18 Claims, 9 Drawing Sheets

RECIPROCATING AIR DISTRIBUTION SYSTEM

BACKGROUND OF THE INVENTION

The field of the present invention is air distribution systems for reciprocating pneumatic devices.

The present invention provides new features for the air distribution system of the air driven diaphragm pump disclosed in U.S. Pat. No. 5,957,670, the disclosure of which is incorporated herein by reference as if set forth here in full. Reference is also made to other disclosures of pumps and actuators found in U.S. Pat. Nos. 5,213,485; 5,169,296; 4,549,467; and 4,247,264. The foregoing patents are also incorporated herein by referenced. Another mechanism to drive an actuator valve is by solenoid such as disclosed in U.S. Pat. No. RE 38,239.

Reciprocating air distribution systems are employed to substantial advantage for driving pneumatically actuated equipment, such as air-driven double diaphragm pumps. These systems are advantageous when shop air or other convenient sources of pressurized air are available. Other pressurized gases are also used to drive these products. The term "air" is generically used to refer to any and all such gases. Driving products with pressurized air is often desirable because such systems avoid components which can create sparks. The actuators can also provide a constant source of pressure by simply being allowed to come to a stall point with the pressure equalized by the resistance of the driven device. As resistance by the driven device is reduced, the system will again begin to operate, creating a system of operations on demand.

A design consideration in the construction of reciprocating actuators is the prospect of developing ice within the device. Ice can disable operation and is most problematic in the exhaust. U.S. Pat. No. 5,957,670 addresses certain issues regarding actuator valve icing.

Other design considerations include performance. With reciprocating devices typically employing alternately charged pistons or diaphragms, increasing the size of the air flow passageways and decreasing flow restrictions improves device performance. This includes promoting flow from a source of pressurized air and rapidly reducing exhaust pressure to avoid resistance.

Air distribution systems providing reciprocating pressure have been made for air driven diaphragm pumps, among other devices. The pumps and associated distribution systems are typically of metal or of polymer material. The material has determined whether or not the device is statically dissipative, metal is and polymer is not. Certain applications require that the device be statically dissipative. A standard has been established for testing elements for their ability to dissipate static. Material considered not to be statically dissipative has a surface resistivity of $1\times10^6$ ohms or less under testing method ASTM D257.

SUMMARY OF THE INVENTION

The present invention is directed to a reciprocating air distribution system. The system includes a valve housing, having a cylinder therein. A valve element is movable within the cylinder. Also provided is an inlet to the cylinder, an exhaust from the cylinder and air distribution passages which are controlled by the valve element to be connected either with the intake or the exhaust.

In a first separate aspect of the present invention, the air distribution system further includes a nonmetallic gasket of thermally insulative material and thickness between the inlet and air distribution passages on one side and the valve element and exhaust on the other.

In a second separate aspect of the present invention, the air distribution system further includes a non-metallic gasket of statically dissipative material between the inlet and air distribution passages on one side and the valve element and exhaust on the other.

In a third separate aspect of the present invention, the reciprocating air distribution system includes a pilot valve and valve control passages from the inlet to both ends of the cylinder with at least one passage controlled by the pilot valve. A nonmetallic gasket provides channels which are part of the valve control passages. These channels are closed by one of the components between which the gasket is located.

In a fourth separate aspect of the present invention, the reciprocating air distribution system includes an air inlet of a combined cross-sectional area of approximately 0.057 square inches and a ratio of combined exhaust port cross-sectional area to combined inlet port cross-sectional area of approximately 8.0 for models achieving up to 180 gallons per minute and an air inlet of a combined cross-sectional area of approximately 0.083 square inches and a ratio of combined exhaust port cross-sectional area to combined inlet port cross-sectional area of approximately 5.4 for models achieving between 180 and 275 gallons per minute.

In a fifth separate aspect of the present invention, the inlet flow capability is matched with the ratio of flow capacity between the exhaust and inlet. This is accomplished by varying the inlet to achieve a target performance, adjusting the ratio of flow capacity by adjusting the exhaust to increase the ratio of flow capacity and repeating the process until the target performance is achieved with maximum efficiency.

In a sixth separate aspect of the present invention, the reciprocating air distribution system includes a muffler in communication with the exhaust. The muffler includes a cavity open to the housing of the valve and separated by an exhaust gasket. The exhaust gasket includes a locking flange extending into the cavity of the muffler to resist the pressure within the reciprocating air distribution system. The exhaust gasket may additionally be constructed of a nonmetallic, thermally insulative material and thickness.

In a seventh separate aspect of the present invention, any of the foregoing separate aspects may be combined to further advantage.

Accordingly, it is an object of the present invention to provide an improved reciprocating air distribution system. Other and further objects and advantages will appear hereinafter.

DETAILED DESCRIPTION OF THE PREFERRED EMBODIMENTS

Figure 1:
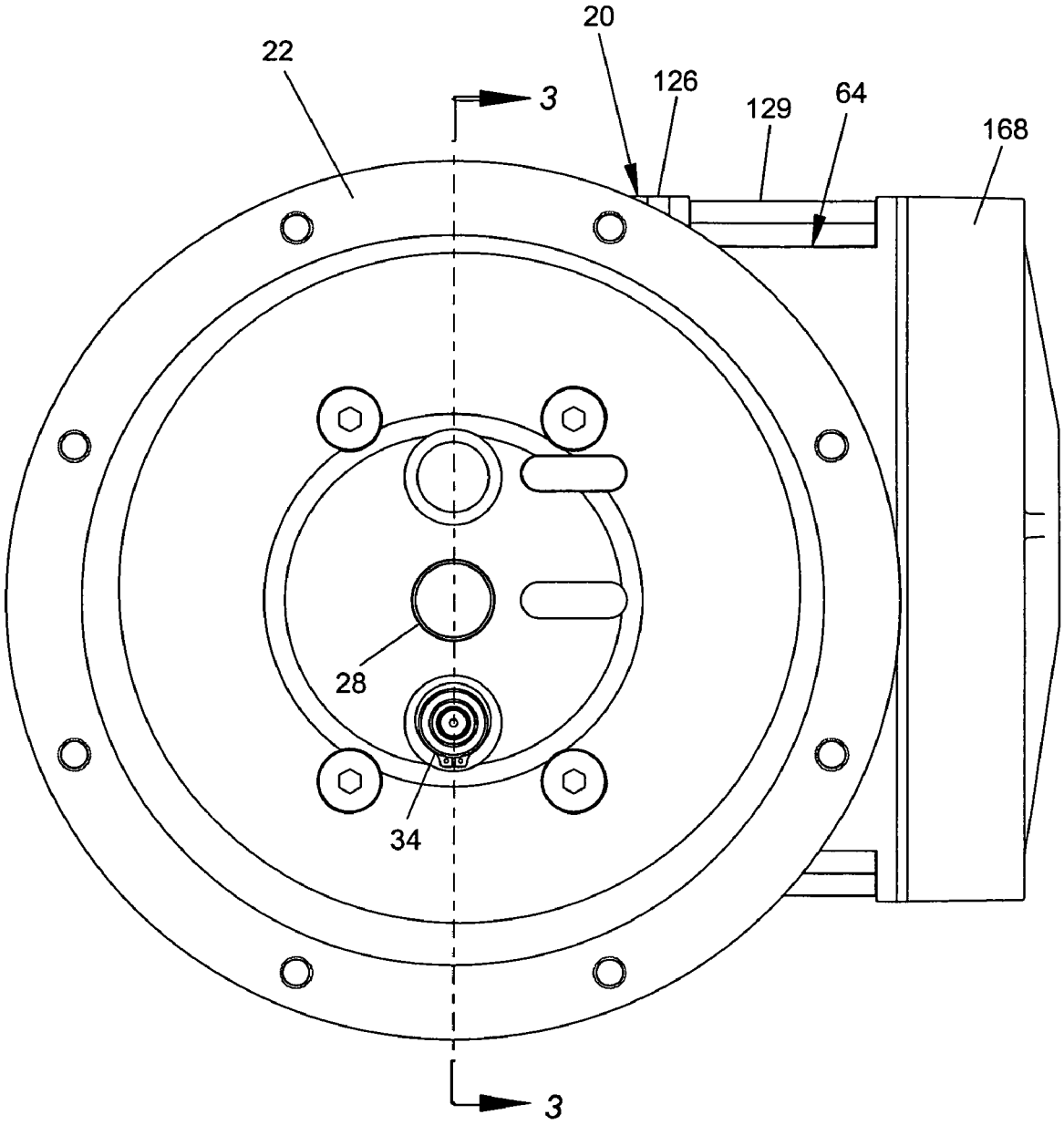
FIG. 1 is a side view of a reciprocating air distribution system.
Figure 2:
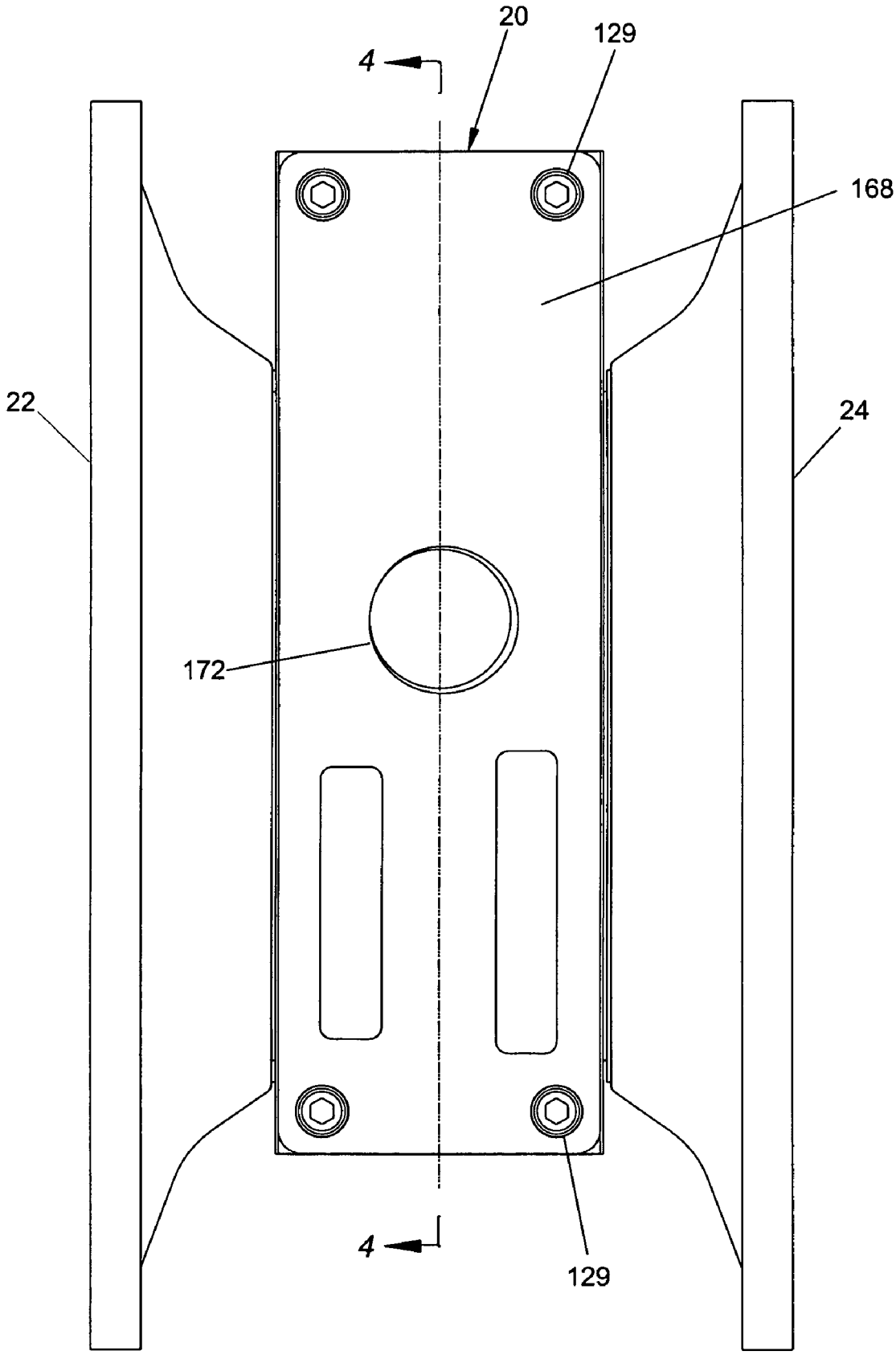
FIG. 2 is an end view of the reciprocating air distribution system.
Figure 3:
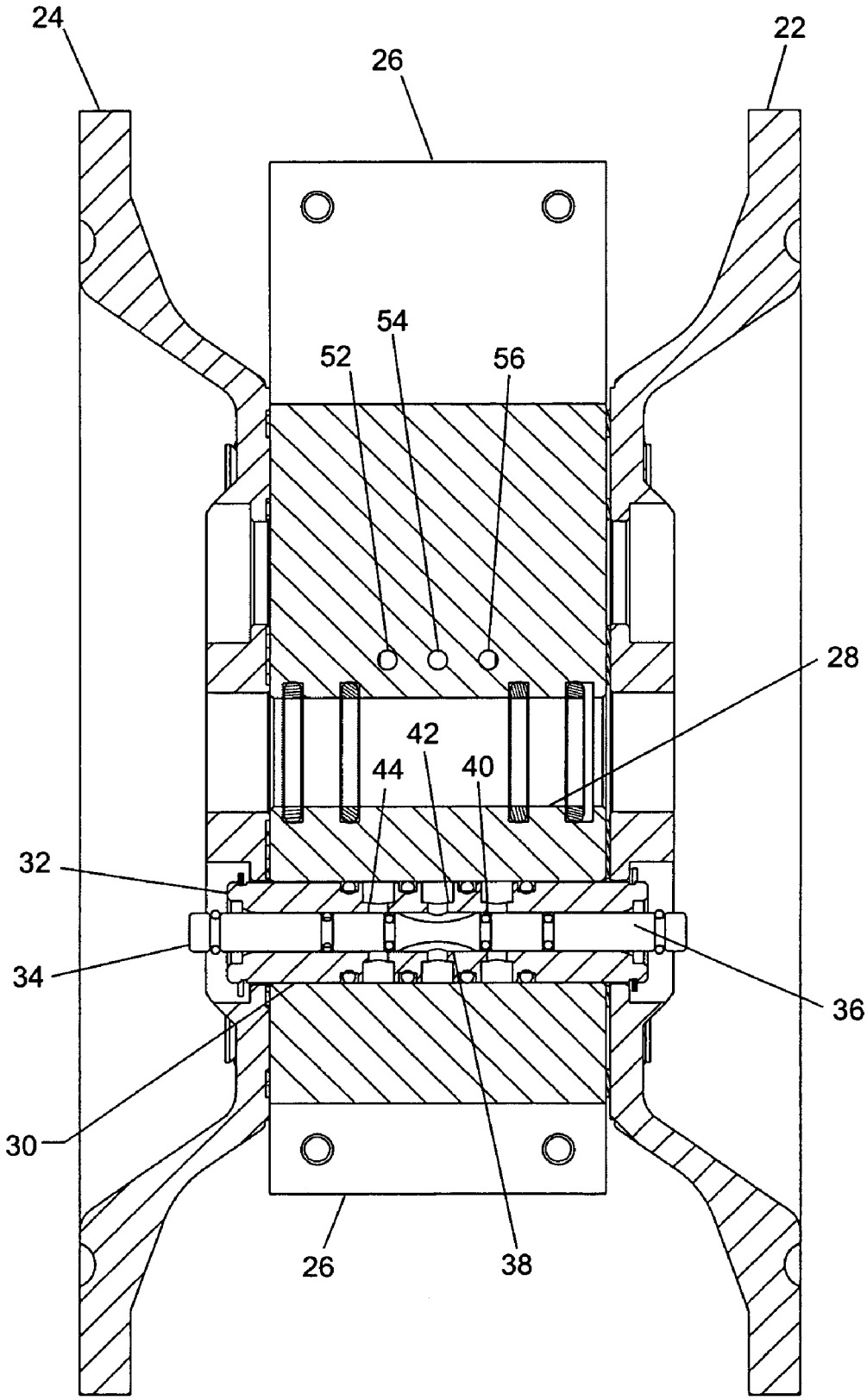
FIG. 3 is a cross-sectional view taken along line 3—3 of FIG. 1.
Figure 4:
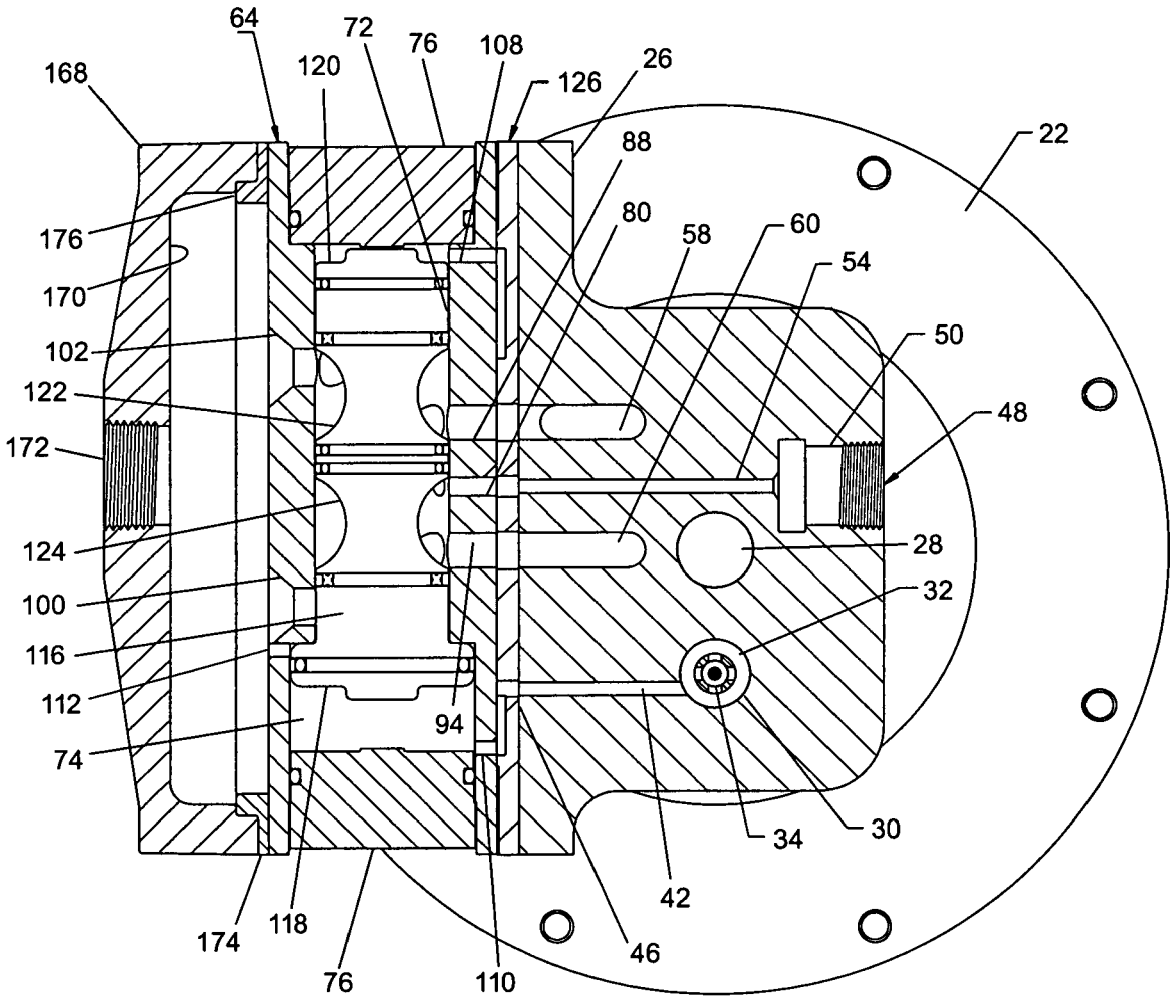
FIG. 4 is a cross-sectional view taken along line 4—4 of FIG. 2.
Figure 5:
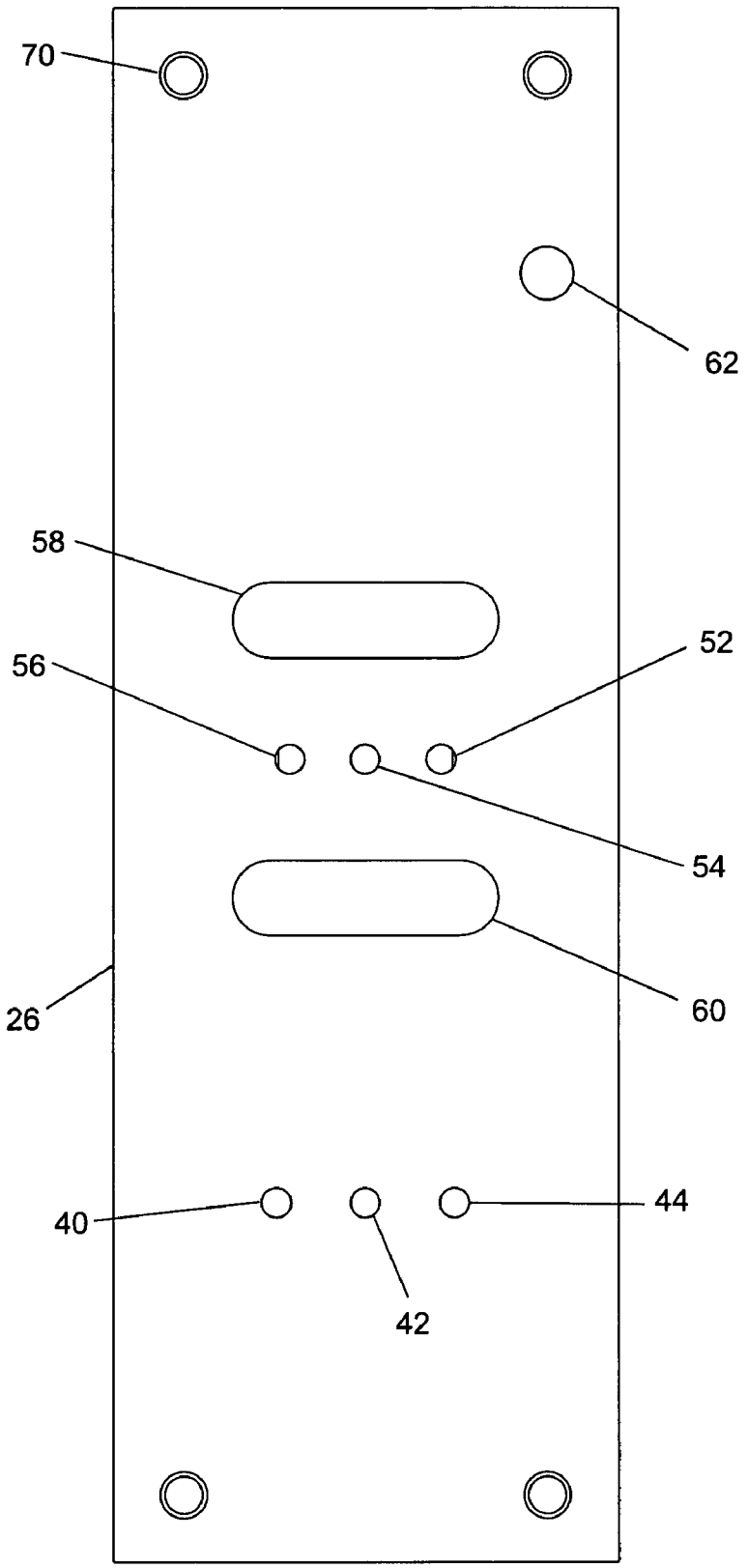
FIG. 5 is a plan view of the face of an air manifold which mounts with an air valve housing.
Figure 7:
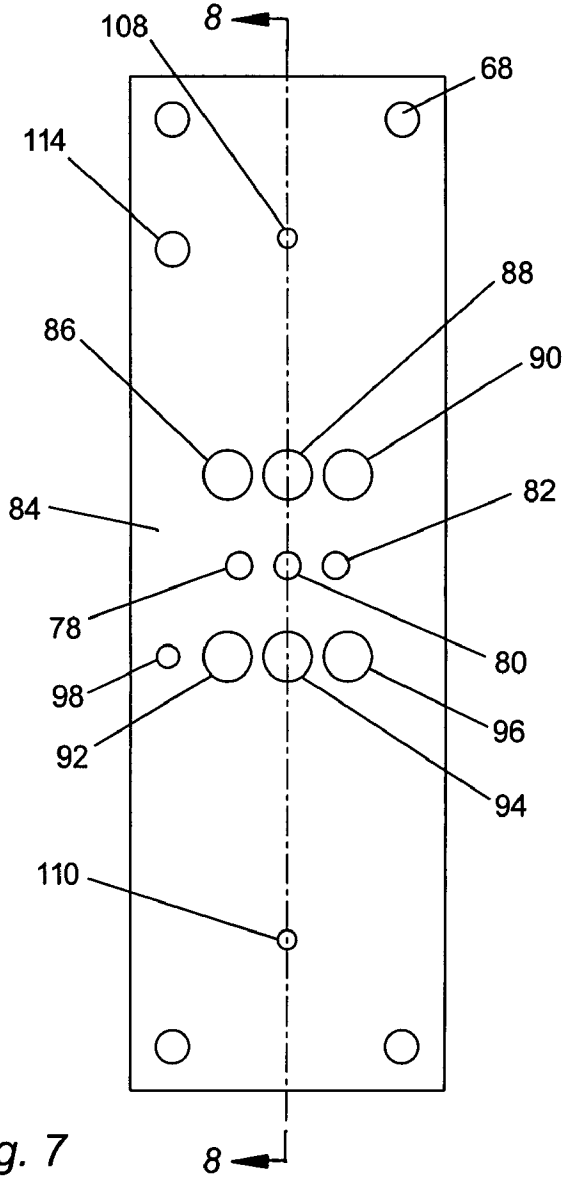
FIG. 7 is the face of the air valve housing which mounts with the air manifold.
Figure 6:
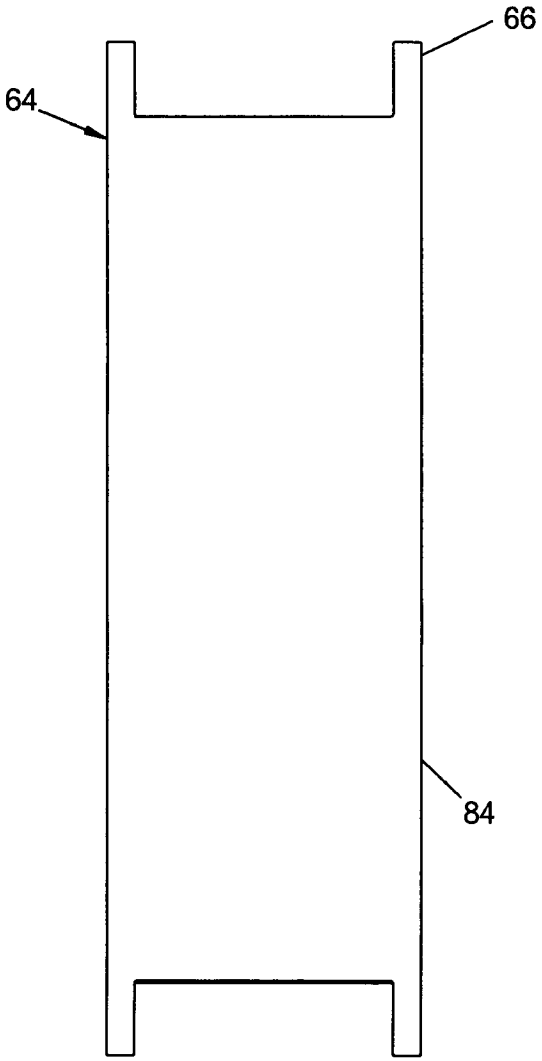
FIG. 6 is a side view of an air valve housing.
Figure 9:
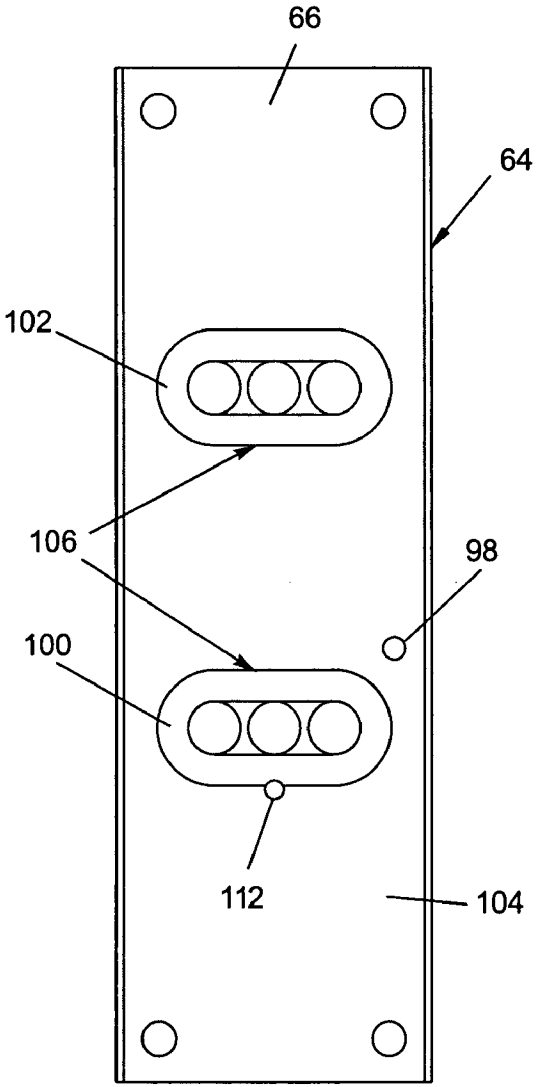
FIG. 9 is the face of the air valve housing which mounts with a muffler.
Figure 8:
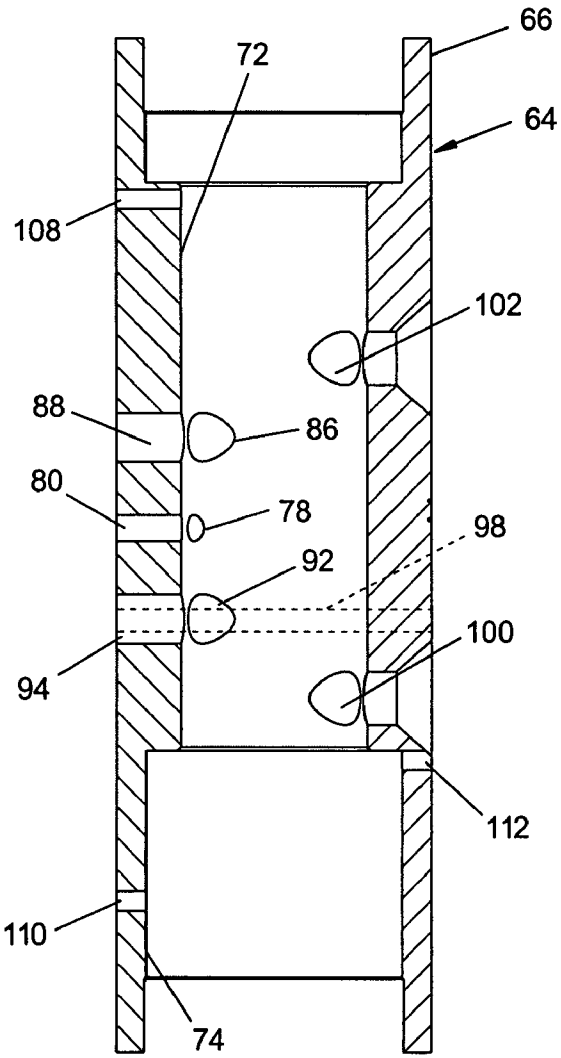
FIG. 8 is a cross-sectional view of the valve housing taken along line 8—8 of FIG. 7.

Turning in detail to the drawings, FIGS. 1 and 2 illustrate a center section for an air driven double diaphragm pump. The center section, generally designated 20, includes two air chambers 22 and 24 to either side of an air manifold 26. The air manifold 26 is hidden in FIGS. 1 and 2 behind the air chamber 22 and a muffler, respectively. The air manifold 26 is illustrated in section in FIGS. 3 and 4. The air chambers 22, 24 are conventional for such pumps and are disclosed in context in U.S. Pat. No. 5,957,670.

The air manifold 26 includes a passageway 28 for receipt of a pump shaft which is slidably mounted therein and attached to working pneumatic elements. A bore 30 extends through the air manifold 26 parallel to the passageway 28 and receives a pilot valve 34. The pilot valve 34 includes a bushing 32 and a shaft 36. The shaft 36 extends into the concavities of the air chambers 22, 24. A longitudinal passage 38 is centered on the shaft 36. The shaft 36 has two extreme positions which are assumed as the diaphragm piston of the associated pump moves back and forth in the air chambers 22, 24.

The air manifold 26 also includes three pilot passages 40, 42, 44 which extend through the bushing 32 to selectively communicate with the longitudinal passage 38. These pilot passages 40, 42, 44 extend to the face 46 of the air manifold 26 which mounts with a valve housing.

The air manifold 26 also has an inlet 48. The inlet 48 includes a tapped access port 50 to receive the fitting to a source of pressure. The inlet 48 also includes three inlet passages 52, 54, 56 which extend in parallel to the face 46. Two air distribution passages 58, 60 extend from the face 46 and in opposite directions to communicate with the air chambers 22, 24. The face 46 includes an indexing hole 62.

A valve housing 64 is mounted to the air manifold 26. The valve housing 64 is substantially square in cross section with a bore therethrough. Four mounting lugs 66 extend beyond the body of the housing 64 and provide holes 68 which align with threaded holes 70 in the air manifold 26 for fasteners to mount the assembly together.

The valve housing 64 includes a first cylindrical bore 72 extending partially through the housing 64 and a second, larger cylindrical bore 74 which is coaxial with the first cylindrical bore 72. The two ends of the valve housing 64 accommodate end caps 76 to close off the first and second cylindrical bores 72, 74. Three inlet ports 78, 80, 82 extend from the mounting face 84 of the valve housing 64 to the first cylindrical bore 72 and are aligned with inlet passages 52, 54, 56 to further define the inlet 48. Air distribution ports 86, 88, 90 align with the air distribution passage 58 while air distribution ports 92, 94, 96 align with the air distribution passage 60. These air distribution ports 86–96 also extend between the first cylindrical bore 72 and the mounting face 84. A through hole 98 extends through the valve housing 64 outwardly of the first cylindrical bore 72.

On the other side of the valve housing 64, exhaust ports 100, 102 extend to the exhaust face 104 of the housing 64. Three holes open into a divergent port to establish communication between the first cylindrical bore 72 and the exhaust face 104 to define an exhaust 106.

Valve control ports 108, 110 extend from the mounting face 84 to the first cylindrical bore 72 and second cylindrical bore 74, respectively. These ports 108, 110 provide part of two valve control passages. A vent 112 extends from the second cylindrical bore 74 to the exhaust face 104. Finally, an index hole 114 is located on the mounting face 84.

A valve element 116 is slidably mounted within the first and second bores 72, 74 of the valve housing 64. The valve element 116 includes a large piston end 118 and a small piston end 120. The large piston end 118 is located in the large cylinder bore 74. The small piston end 120 and two longitudinal valve passages 122, 124 are located in the smaller cylinder bore 72. Seals about the valve element 116 pneumatically separate the large piston end 118, the small piston end 120 and the valve passages 122, 124. The vent 112 maintains the back side of the large piston end 118 at reduced pressure.

The two valve passages 122, 124 alternately open communication between the air distribution passages 58, 60 and the inlet 48 or the exhaust 106. The valve element/piston arrangement is commonly referred to as an unbalanced spool. Because of the relative sizes of the large piston end 118 and the small piston end 120, continuous inlet pressure to both ends will result in the valve element 116 being driven by the large piston end 118 toward the small piston end 120. Only when pressure is relieved from the large piston end 118 will the valve piston 116 move in the direction of the large piston end 118.

Figure 12:
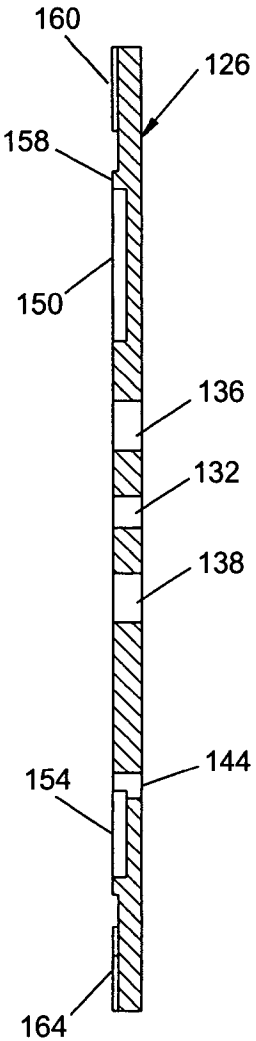
FIG. 12 is a cross-sectional view of the gasket taken along line 12—12 of FIG. 10.
Figure 10:
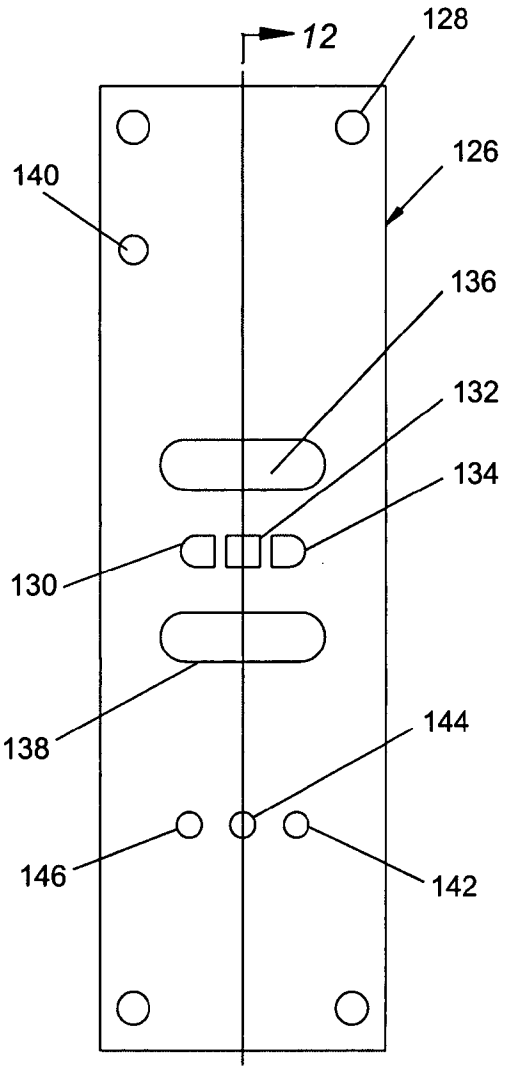
FIG. 10 is a top view of a gasket.

A nonmetallic gasket, generally designated 126, is positioned between the air manifold 26 and the valve housing 64. This gasket 126 is made of a thermally insulative material and is thick. In this embodiment, the material is buna elastomer and the gasket is 0.200 inches thick. The gasket is shown in position in FIG. 4 and is shown in detail in FIGS. 10, 11 and 12. The gasket 126 is shown to have through holes 128 in the corners for accommodation of fasteners 129. Three inlet holes 130, 132, 134 are aligned with the inlet passages 52, 54, 56 in the air manifold 26, respectively. Oblong holes 136, 138 are aligned with the air distribution passages 58, 60, respectively. A raised indexing peg 140 on the air manifold side of the gasket 126 aligns with the indexing hole 62 on the face 46 of the air manifold 26. Finally, three ports 142, 144, 146 align with the pilot passages 40, 42, 44, respectively.

Looking to the valve housing side of the gasket 126, the ports and through holes referred to above are apparent on this side as well. A second raised indexing peg 148 cooperates with the index hole 114 in the mounting face 84 of the valve housing 64. Valve control passages are formed as channels 150, 152 in the surface of the gasket 126. The channel 150 extends from the inlet hole 130 to the valve control port 108. This passage from the inlet passage 52 to the inlet hole 130 to the channel 150 and finally to the valve control port 108 is continuously pressurized during operation. Thus, pressure is maintained at the small piston end 120.

The channel 152 extends from the inlet hole 134 which in turn is in communication with the inlet passage 56 to also provide a constant source of pressure through the channel 152. The channel 152 does not go to the large piston end 118. Rather, it extends to the pilot passage 40. This passage is constantly pressurized during operation to provide pressure to the pilot valve 34. The pilot passage 42 extends to the gasket 126 to be in fluid communication with a channel 154, also formed in the surface of the gasket 126, through the port 144. This channel 154 extends to the valve control port 110 to pressurize the large piston end 118. A further channel 156 extends to the through hole 98 and to exhaust. Thus, one valve control passage extends through the channel 150 to the small piston end 120 while the valve control passage to the large piston end 118 is controlled by the pilot valve 34 which can alternatively provide pressure or venting to control the location of the valve element 116. These channels 150, 152, 154, 156 in the gasket 126 are rectangular in cross section and are 0.2 inches wide and 0.12 inches deep.

Figure 11:
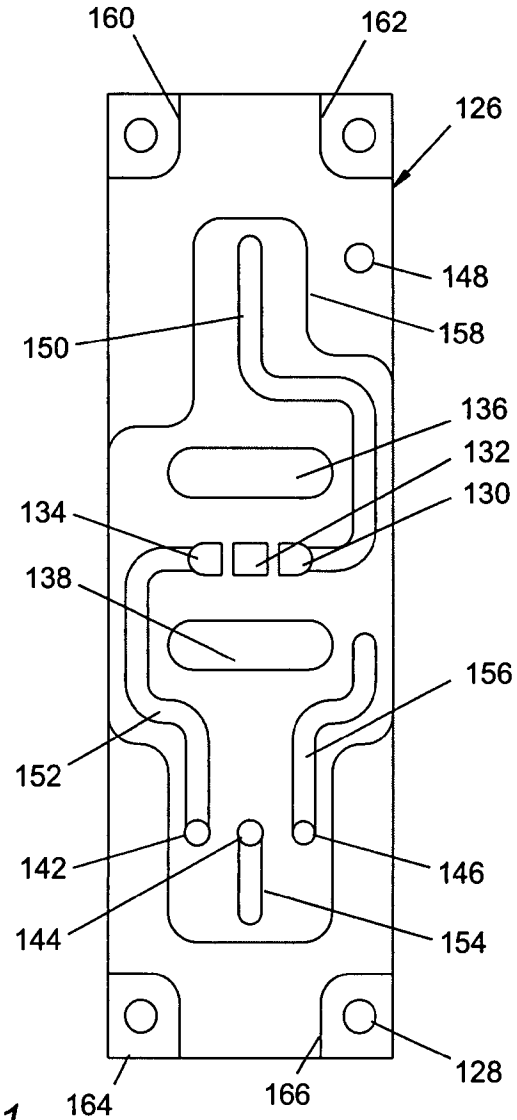
FIG. 11 is a bottom view of the gasket.

Another feature found on the face of the gasket in FIG. 11 which mates with the mounting face 84 of the valve housing 64 is the presence of a raised compression surface 158 about the channels 150–156 and several ports. Four additional raised compression surfaces 160, 162, 164, 166 surround the holes 128 receiving fasteners. The raised compression surface 158 is designed to increase the mating pressure between the gasket 126 and the mounting face 84 of the valve housing 64. The raised compression surfaces 160–166 act to stabilize the relationship between the gasket 126 and the air manifold 26 and the valve housing 64 so that bolting the components together can occur with random tightening without the components being cocked inappropriately. These raised surfaces add 0.05 inches to the 0.20 inch think gasket.

The gasket 126 can isolate the manifold 26 from the valve housing 64. The present air distribution system is metal but is not statically dissipative but for conductivity through the gasket 126. The gasket 126 is of buna elastomer with a filler of carbon black to lower the surface resistivity below the standard for electically resistive material in ASTM D 257 of above $1\times10^6$ ohms. With this material in the gasket 126, the metal components in the preferred embodiment of this air distribution system are protected from static.

Figure 13:
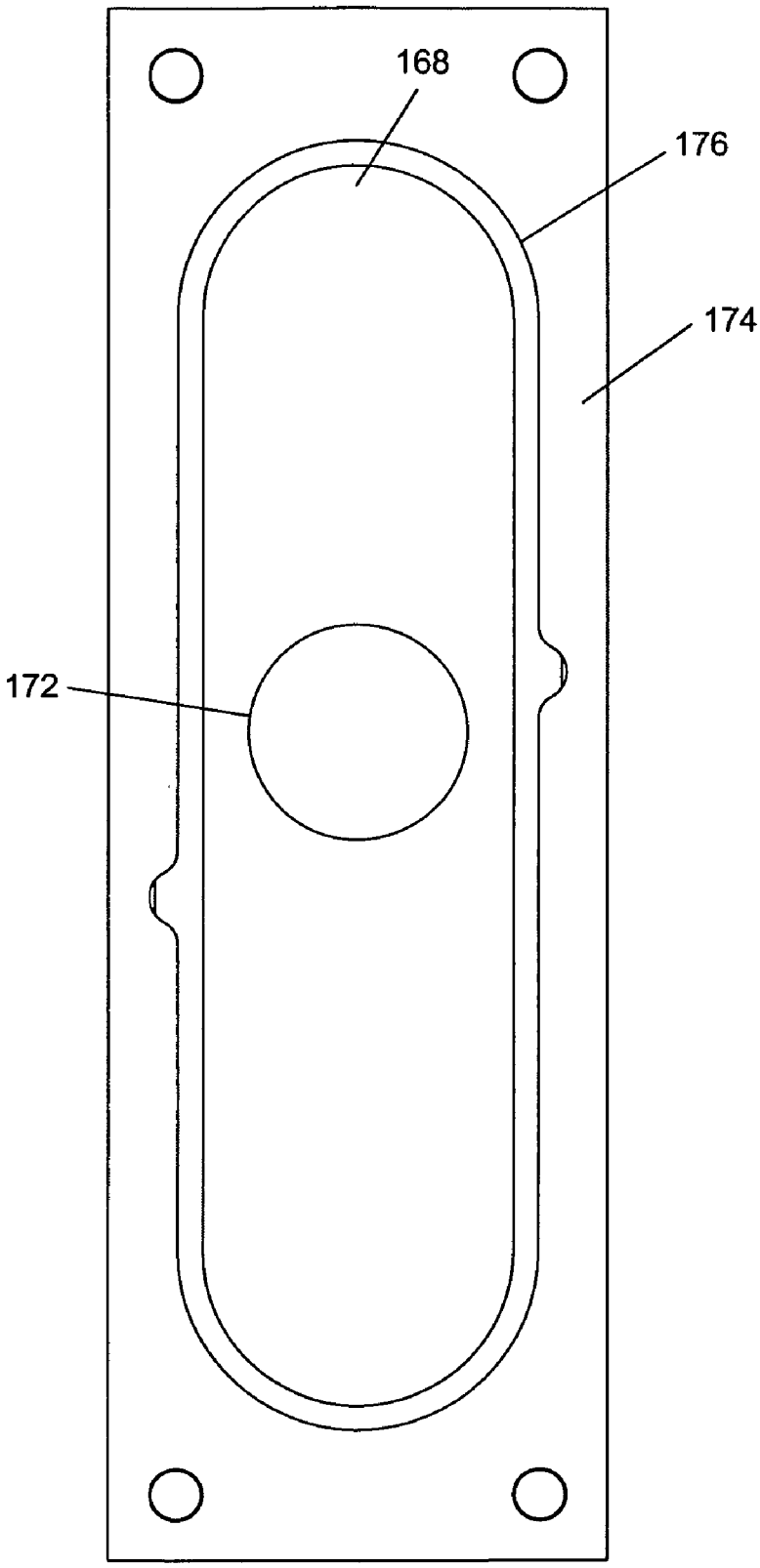
FIG. 13 is a plan view of a muffler and muffler gasket.

A muffler 168 is located on the exhaust side of the valve housing 64. This muffler has a cavity 170 for expansion and an outlet 172 there from. An exhaust gasket 174 is located between the muffler 168 and the exhaust face 104 of the valve housing 64. As can be seen in FIG. 13, the exhaust gasket 174 has two long sides. These sides are subject to substantial pressure because of their length which tend to blow the gasket from between the muffler 168 and the valve housing 64. The exhaust gasket includes a locking flange 176 which extends into the cavity 170 of the muffler 168. With this flange 176 associated with the gasket 174, blow out of the gasket from pressure is avoided.

In operation, the reciprocating air distribution system receives a constant source of pressurized air through the access port 50 and inlet passages 52, 54, 56. Depending on the location of the valve element 116, pressurized air from the inlet passages 52, 54, 56 is directed to one or the other of the air distribution passages 58, 60 which alternately pressurize the chambers of the associated pneumatic device. Again, depending on the position of the valve element 116, the other of the air distribution passages 58, 60 is in fluid communication with the exhaust 106. Thus, reciprocating motion is achieved.

To control the location of the valve element 116, a mechanical feedback loop is employed. The actuated device driven by pressurized air through the air distribution passages 58, 60 completes a stroke which causes the pilot valve 34 to shift. The pilot valve 34 alternately pressurizes the valve control passage to the large piston end 118 or directs the pressure to vent. When pressurized, the force of the large piston end 118 overcomes the force on the small piston end 120 and the valve is shifted toward the small piston end 120. When the pilot valve 34 vents the air from the valve control passage, the large piston end 118 can no longer overcome the constant pressure behind the small piston end 120 and the valve shifts toward the large piston end 118. The reciprocating air distribution system continues in this sequence to alternately power one side or the other of the pressure responsive system in the driven pneumatic device.

Commonly shop air or other untreated pressurized air is employed to drive such reciprocating air distribution systems. Compressed air typically contains moisture or moisture vapor. Consequently, there is some liquid moisture flow through such reciprocating air distribution systems. This air is also going from a compressed state to an atmospheric state as it passes through the entire system from the inlet to the muffler. As pressure drops, cooling of the air occurs.

The final cooling takes places in the exhaust system and muffler. Under continued operation, the combination of the pressure drop and the moisture in the distribution system can cause icing under some circumstances. Icing generally is initiated at the exhaust. The low temperatures can then be transmitted through the reciprocating air distribution system to cool and ice up vulnerable parts of the distribution system. The valve control passages, which are typically smaller than the other passages, are such susceptible elements.

The use of the thick and thermally insulative nonmetallic gasket 126 keeps the cold generated in the exhaust system from passing to the air manifold 26. Additionally, the channels 150–156 which are located in the gasket 126 are less susceptible to freezing because of the material defining the channels. These channels can be arranged facing the valve housing 64 as shown in the preferred embodiment or facing the air manifold 26. The exhaust gasket 174 also provides insulative properties to separate the cold muffler 168 from the valve housing 64.

The present reciprocating air distribution system is also designed with a reduced flow capacity through the inlet 48 relative to the flow capacity of the exhaust 106. The operating capacity of the driven pneumatic device is dependent upon flow rate of the driving air through the reciprocating air distribution system. Consequently, it has been common practice to simply increase the flow capacity of both the inlet 48 and the exhaust 106 to accomplish appropriate operating rates. However, the efficiency of the system has been found to depend in part on the rapid exhausting of spent air from the system such that the incoming air is not required to work against the unspent air pressure. By establishing a lower inlet flow capacity, the exhaust flow is able to vent before excessive pressure is built up from the lower capacity inlet. As advantageous efficiency versus flow rate are best determined empirically, a process may be used to maximize efficiency by changing the ratio of flow capacity between the exhaust 106 and inlet 48. The ratio is typically above 4.0 for efficient operation. The process must be an iterative series of steps. The first step is to make this ratio larger until a maximum efficiency is reached. Reducing the inlet without reducing the exhaust increases efficiency. At the same time, it can reduce the performance response from the driven device, most commonly output flow rate of a pump. Making the exhaust bigger relative to the inlet increases efficiency but also can increase performance. To achieve an efficient air distribution system with a specific flow characteristic, selecting an inlet flow capability, followed by increasing the exhaust flow capability to achieve efficiency increases the flow beyond the setting to the inlet. Thus, the inlet must be further reduced. This process is employed until the correct flow rate with maximum efficiency is achieved.

An advantageous configuration in this embodiment entails air inlet passages 52, 54, 56 of a combined cross-sectional area of approximately 0.057 square inches and a ratio of combined exhaust port cross-sectional area to combined inlet passage cross-sectional area of approximately 8.0 for models achieving up to 180 gallons per minutes. For larger sizes, advantage is found in air inlet passages 52, 54, 56 of a combined cross-sectional area of approximately 0.083 square inches and a ratio of combined exhaust port cross-sectional area to combined inlet passage cross-sectional area of approximately 5.4 for models achieving between 180 and 275 gallons per minutes.

Thus, an improved reciprocating air distribution system is disclosed. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. A reciprocating air distribution system comprising
a valve housing including a cylinder;
a valve element in the cylinder;
an inlet to the cylinder;
an air manifold including two air distribution passages from the cylinder;
an exhaust from the cylinder;
valve control passages extending from the inlet to both ends of the cylinder;
a nonmetallic gasket between the air manifold and the valve housing of thermally insulative material and thickness, the valve control passages including channels in the nonmetallic gasket.

2. The reciprocating air distribution system of claim 1, the gasket being buna elastomer.

3. The reciprocating air distribution system of claim 1, the gasket being about 0.20 inches thick.

4. The reciprocating air distribution system of claim l, the gasket being statically dissipative.

5. The reciprocating air distribution system of claim 1 further comprising
fasteners extending between the valve housing and the air manifold holding the gasket in compression therebetween, the gasket including raised compression surfaces extending outwardly from the gasket about the fasteners.

6. The reciprocating air distribution system of claim 5, the raised compression surfaces being 0.050" thick.

7. A reciprocating air distribution system comprising
a valve housing including a cylinder;
a valve element in the cylinder;
an inlet to the cylinder;
an air manifold including two air distribution passages from the cylinder;
an exhaust from the cylinder;
a nonmetallic gasket between the air manifold and the valve housing being statically dissipative.

8. A reciprocating air distribution system comprising
a valve housing including a cylinder;
an inlet to the cylinder;
an air manifold including two air distribution passages from the cylinder;
an exhaust from the cylinder;
a pilot valve;
a valve element slidable in the cylinder and controlling communication from the inlet to the two air distribution passages and from the two air distribution passages to the exhaust;
valve control passages extending from the inlet to both ends of the cylinder, at least one of the valve control passages being controlled by the pilot valve;
a nonmetallic gasket between the air manifold and the valve housing, the valve control passages including channels in the nonmetallic gasket closed by one of the air manifold and the valve housing.

9. The reciprocating air distribution system of claim 8, the nonmetallic gasket being closed by the valve housing.

10. The reciprocating air distribution system of claim 8, the gasket being molded with the channels.

11. The reciprocating air distribution system of claim 8, the nonmetallic gasket between the air manifold and the valve housing being of thermally insulative material and thickness.

12. The reciprocating air distribution system of claim 11, the gasket being statically dissipative.

13. The reciprocating air distribution system of claim 8, the gasket being statically dissipative.

14. The reciprocating air distribution system of claim 8 further comprising
fasteners extending between the valve housing and the air manifold holding the gasket in compression therebetween, the gasket including raised compression surfaces extending outwardly from the gasket about the fasteners and the channels.

15. A reciprocating air distribution system comprising a valve housing including a cylinder;
a valve element in the cylinder;
an inlet to the cylinder including at least one air inlet passage;
an air manifold including two air distribution passages from the cylinder;
an exhaust from the cylinder including at least one exhaust port, the at least one air inlet passage having a combined cross-sectional area of approximately 0.057 square inches and a ratio of combined exhaust port cross-sectional area to combined inlet passage area of approximately 8.0 for models achieving up to 180 gallons per minute, and the at least one air inlet passage having a combined area of approximately 0.083 square inches and a ratio of combined exhaust port cross-sectional area to combined inlet passage cross-sectional area of approximately 5.4 for models achieving between 180 and 275 gallons per minute.

16. A reciprocating air distribution system comprising
a valve housing including a cylinder;
a valve element in the cylinder;
an inlet to the cylinder;
an air manifold including two air distribution passages from the cylinder;
an exhaust from the cylinder;
a muffler in communication with the exhaust from the cylinder;
an exhaust gasket between the valve housing and the muffler and about the exhaust, the muffler including a cavity open to the valve housing, the exhaust gasket including a locking flange extending into the cavity.

17. The reciprocating air distribution system of claim 16, the exhaust gasket between the valve housing and the muffler being of thermally insulative material and thickness.

18. The reciprocating air distribution system of claim 17, the gasket being statically dissipative.

* * * * *